US011525422B1

(12) United States Patent
Dudar

(10) Patent No.: US 11,525,422 B1
(45) Date of Patent: Dec. 13, 2022

(54) DIAGNOSTIC FOR A FUEL CANISTER HEATING SYSTEM

(71) Applicant: FORD GLOBAL TECHNOLOGIES, LLC, Dearborn, MI (US)

(72) Inventor: Aed M Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/373,894

(22) Filed: Jul. 13, 2021

(51) Int. Cl.
*F02M 25/08* (2006.01)

(52) U.S. Cl.
CPC .... *F02M 25/0818* (2013.01); *F02M 25/0809* (2013.01); *F02M 25/0836* (2013.01); *F02M 25/0854* (2013.01); *F02M 2025/0881* (2013.01)

(58) Field of Classification Search
CPC ..... F02M 25/0818; F02M 25/0809; F02M 25/0836; F02M 25/0854; F02M 2025/0881
See application file for complete search history.

(56) References Cited

U.S. PATENT DOCUMENTS 6,098,601 A * 8/2000 Reddy ..... F02D 35/00 123/557
6,230,693 B1 * 5/2001 Meiller ..... F02M 25/0854 123/557
6,279,548 B1 * 8/2001 Reddy ..... B60K 15/03504 123/557
6,321,727 B1 * 11/2001 Reddy ..... F02M 25/0809 123/520
2002/0162457 A1 * 11/2002 Hyodo ..... F02M 25/0872 96/144
2002/0174857 A1 * 11/2002 Reddy ..... F02M 25/0854 123/520
2003/0074958 A1 * 4/2003 Nagasaki ..... F02M 25/0827 73/114.39
2005/0234631 A1 * 10/2005 Nomura ..... F02M 25/0809 701/102
2016/0138528 A1 * 5/2016 Burleigh ..... B60L 7/26 123/520
2017/0114732 A1 4/2017 Dudar
2018/0058384 A1 * 3/2018 Dudar ..... F02D 41/221
2019/0055905 A1 * 2/2019 Dudar ..... F02D 41/004

* cited by examiner

*Primary Examiner* — Phutthiwat Wongwian
*Assistant Examiner* — Susan E Scharpf
(74) *Attorney, Agent, or Firm* — Vincent Mastrogiacomo; Brooks Kushman P.C.

(57) ABSTRACT

A vehicle includes a fuel tank, a canister, a first valve, a second valve, a heater, and a controller. The fuel tank is configured to store fuel. The canister is in fluid communication with the fuel tank and is configured to receive and store evaporated fuel from the fuel tank. The first valve is disposed between the fuel tank and the canister. The second valve is disposed between the canister and ambient surroundings. The heater is disposed within the canister. The controller is programmed to, periodically initiate diagnostic tests that are configured to determine if the heater is operating properly, if the heater is unable to turn off, or if the heater is unable to turn on.

20 Claims, 6 Drawing Sheets

DIAGNOSTIC FOR A FUEL CANISTER HEATING SYSTEM

TECHNICAL FIELD

The present discloser relates to fuel systems for vehicles.

BACKGROUND

Vehicles may include fuel systems that are configured to deliver fuel from a fuel tank to an internal combustion engine.

SUMMARY

A vehicle includes a fuel tank, a canister, a first valve, a second valve, a heater, and a controller. The fuel tank is configured to store fuel. The canister is in fluid communication with the fuel tank and is configured to receive and store evaporated fuel from the fuel tank. The first valve is disposed between the fuel tank and the canister. The second valve is disposed between the canister and ambient surroundings. The heater is disposed within the canister. The controller is programmed to, periodically initiate a diagnostic test, the diagnostic test including, opening the first valve, closing the second valve, deactivating the heater, and sensing a vapor pressure within the fuel tank. The controller is further programmed to, in response to the vapor pressure being less than a threshold during the diagnostic test, output a signal indicating that the heater is operating properly. The controller is further programmed to, in response to the vapor pressure exceeding the threshold during the diagnostic test, output a signal indicating that the heater is unable to turn off.

A vehicle includes a fuel tank, a canister, a fuel tank vent valve, a canister vent valve, a pressure sensor, an electric heater, and a controller. The fuel tank is configured to store fuel. The canister is in fluid communication with the fuel tank. The canister is also configured to receive evaporated fuel from the fuel tank, store the evaporated fuel via adsorption, and deliver the evaporated fuel to an engine via desorption. The fuel tank vent valve is disposed between the fuel tank and the canister. The fuel tank vent valve is configured to facilitate fuel vapor flow from the fuel tank to the canister when open and to isolate the fuel tank from the canister when closed. The canister vent valve is disposed between the canister and ambient surroundings. The canister vent valve is configured to facilitate fluid communication between the canister and the ambient surroundings when open and to isolate the canister from the ambient surroundings when closed. The pressure sensor is disposed between the canister and the fuel tank and is configured to measure a pressure of the fuel vapor. The electric heater is disposed within the canister and is configured to accelerate desorption. The controller is programmed to periodically initiate a first diagnostic test and periodically initiate a second diagnostic test. The first diagnostic test includes opening the fuel tank vent valve, closing the canister vent valve, and activating the electric heater. The controller is further programmed to, in response to the pressure sensor sensing an increase in the pressure of the fuel vapor exceeding a threshold during the first diagnostic test, output a signal indicating that the electric heater is operating properly. The controller is further programmed to, in response to the pressure sensor sensing the increase in the pressure of the fuel vapor being less than the threshold during the first diagnostic test, output a signal indicating that the electric heater is unable to turn on. The second diagnostic test includes opening the fuel tank vent valve, closing the canister vent valve, and deactivating the electric heater. The controller is further programmed to, in response to the pressure sensor sensing the increase in the pressure of the fuel vapor being less than the second threshold during the second diagnostic test, output a signal indicating that the electric heater is operating properly. The controller is further programmed to, in response to the pressure sensor sensing the increase in the pressure of the fuel vapor exceeding a second threshold during the second diagnostic test, output a signal indicating that the electric heater is unable to turn off.

A vehicle includes a fuel tank, a canister, a first valve, a second valve, a heater, and a controller. The fuel tank is configured to store fuel. The canister is in fluid communication with the fuel tank and is configured to receive and store evaporated fuel from the fuel tank. The first valve is disposed between the fuel tank and the canister. The second valve is disposed between the canister and ambient surroundings. The heater is disposed within the canister. The controller is programmed to, periodically initiate a diagnostic test, the diagnostic test including, opening the first valve, closing the second valve, activating the heater, and sensing the vapor pressure within the fuel tank. The controller is further programmed to, in response to the vapor pressure being greater than a threshold during the diagnostic test, output a signal indicating that the electric heater is operating properly. The controller is further programmed to, in response to the vapor pressure being less than the threshold during the diagnostic test, output a signal indicating that the electric heater is unable to turn on.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
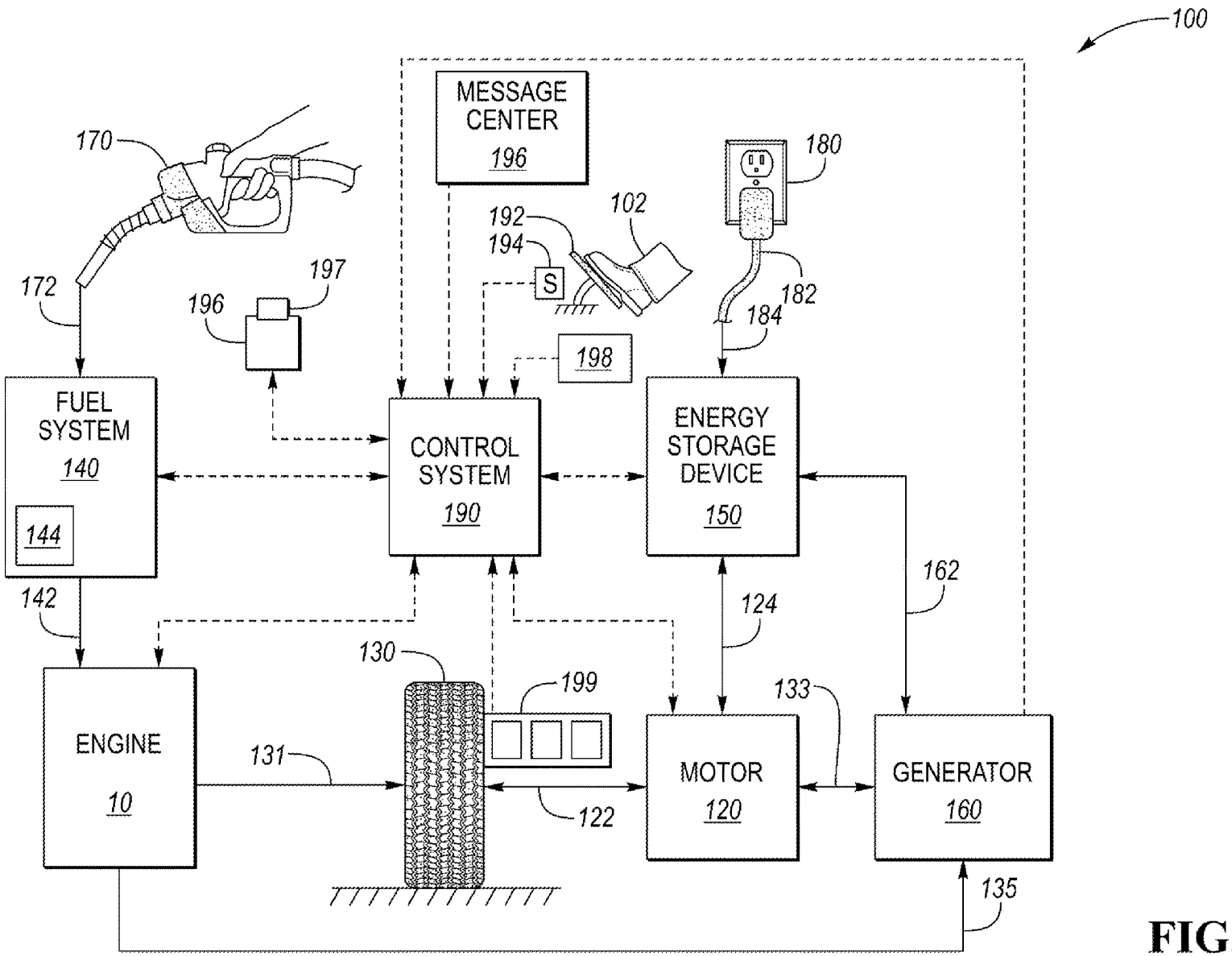
FIG. 1 is a schematic illustration of a vehicle propulsion system.

FIG. 1 illustrates an example vehicle and vehicle propulsion system 100. Vehicle propulsion system 100 includes a fuel burning engine 10 and a motor 120. As a non-limiting example, engine 10 comprises an internal combustion engine and motor 120 comprises an electric motor. Motor 120 may be configured to utilize or consume a different energy source than engine 10. For example, engine 10 may consume a liquid fuel (e.g., gasoline) to produce an engine output while motor 120 may consume electrical energy to produce a motor output. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 10 to be maintained in an off state (i.e., set to a deactivated state) where combustion of fuel at the engine is discontinued. For example, under select operating conditions, motor 120 may propel the vehicle via drive wheel 130 as indicated by arrow 122 while engine 10 is deactivated.

During other operating conditions, engine 10 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some examples. However, in other examples, generator 160 may instead receive wheel torque from drive wheel 130, where the generator may convert the kinetic energy of the vehicle to electrical energy for storage at energy storage device 150 as indicated by arrow 162.

During still other operating conditions, engine 10 may be operated by combusting fuel received from fuel system 140 as indicated by arrow 142. For example, engine 10 may be operated to propel the vehicle via drive wheel 130 as indicated by arrow 131 while motor 120 is deactivated. During other operating conditions, both engine 10 and motor 120 may each be operated to propel the vehicle via drive wheel 130 as indicated by arrows 131 and 122, respectively. A configuration where both the engine and the motor may selectively propel the vehicle may be referred to as a parallel type vehicle propulsion system. Note that in some examples, motor 120 may propel the vehicle via a first set of drive wheels and engine 10 may propel the vehicle via a second set of drive wheels.

In other examples, vehicle propulsion system 100 may be configured as a series type vehicle propulsion system, whereby the engine does not directly propel the drive wheels. Rather, engine 10 may be operated to power motor 120, which may in turn propel the vehicle via drive wheel 130 as indicated by arrow 122. For example, during select operating conditions, engine 10 may drive generator 160 as indicated by arrow 135, which may in turn supply electrical energy to one or more of motor 120 as indicated by arrow 133 or energy storage device 150 as indicated by arrow 162. As another example, engine 10 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g., E10, E85, etc.) or a blend of gasoline and methanol (e.g., M10, M85, etc.), whereby these fuels or fuel blends may be delivered to engine 10 as indicated by arrow 142. Still other suitable fuels or fuel blends may be supplied to engine 10, where they may be combusted at the engine 10 to produce an engine output. The engine output may be utilized to propel the vehicle as indicated by arrow 131 or to recharge energy storage device 150 via motor 120 or generator 160.

In some examples, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 10, motor 120, fuel system 140, energy storage device 150, and generator 160. Control system 190 may receive sensory feedback information from one or more of engine 10, motor 120, fuel system 140, energy storage device 150, and generator 160. Further, control system 190 may send control signals to one or more of engine 10, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal.

Energy storage device 150 may periodically receive electrical energy from a power source 180 residing external to the vehicle (e.g., not part of the vehicle) as indicated by arrow 184. As a non-limiting example, vehicle propulsion system 100 may be configured as a plug-in hybrid electric vehicle (PHEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may disconnected between power source 180 and energy storage device 150. Control system 190 may identify and/or control the amount of electrical energy stored at the energy storage device, which may be referred to as the state of charge (SOC).

In other examples, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 10.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some examples, fuel tank 144 may be configured to store the fuel received from fuel dispensing device 170 until it is supplied to engine 10 for combustion. In some examples, control system 190 may receive an indication of the level of fuel stored at fuel tank 144 via a fuel level sensor. The level of fuel stored at fuel tank 144 (e.g., as identified by the fuel level sensor) may be communicated to the vehicle operator, for example, via a fuel gauge or indication in a vehicle instrument panel 196.

The vehicle propulsion system 100 may also include an ambient temperature/humidity sensor 198, and a roll stability control sensor, such as a lateral and/or longitudinal and/or yaw rate sensor(s) 199. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be manually actuated or pressed by a vehicle operator to initiate refueling. For example, as described in more detail below, in response to the vehicle operator actuating refueling button 197, a fuel tank in the vehicle may be depressurized so that refueling may be performed.

In an alternative example, the vehicle instrument panel 196 may communicate audio messages to the operator without display. Further, the sensor(s) 199 may include a vertical accelerometer to indicate road roughness. These devices may be connected to control system 190. In one example, the control system may adjust engine output and/or the wheel brakes to increase vehicle stability in response to sensor(s) 199.

Figure 2:
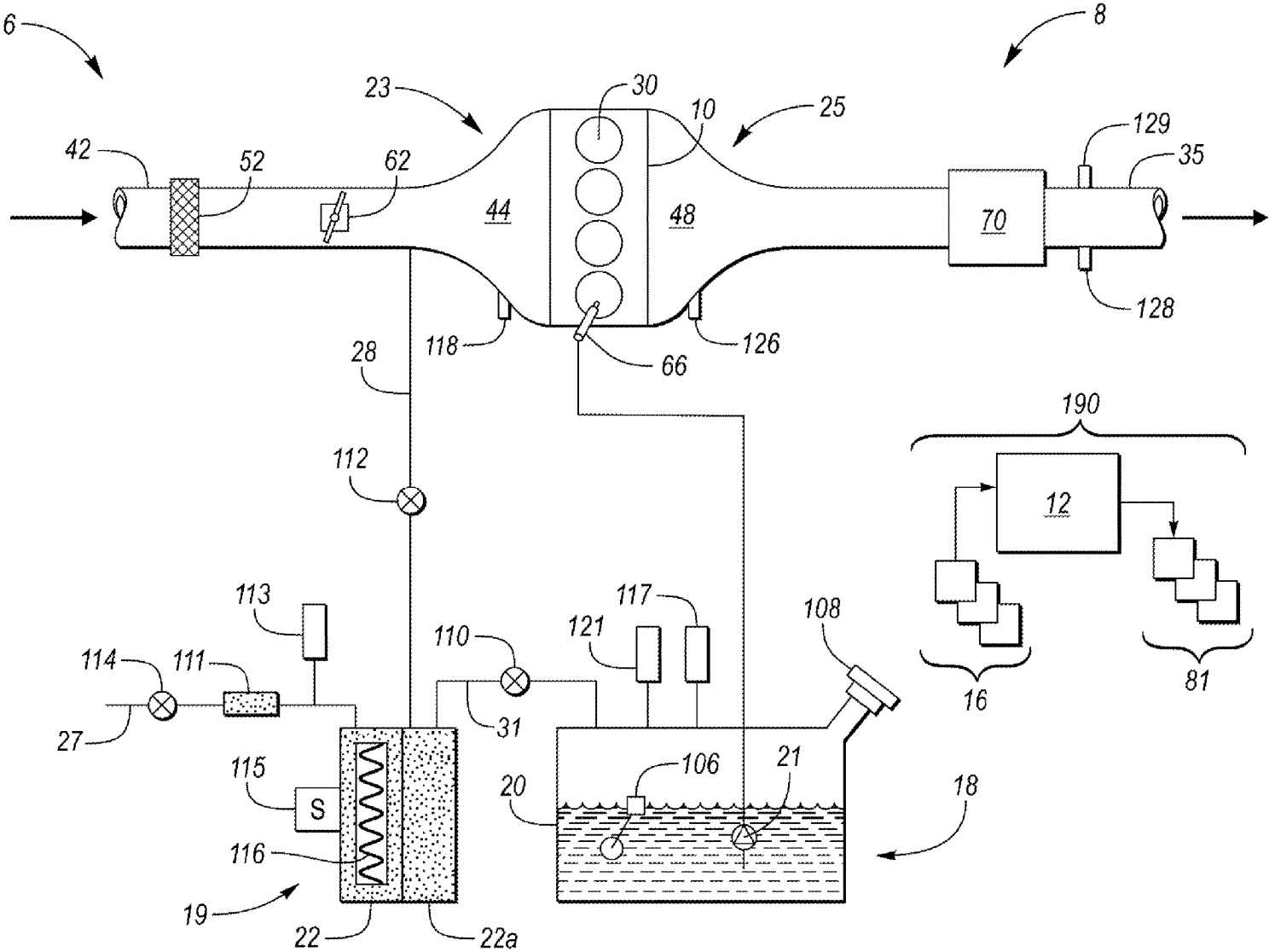
FIG. 2 is a schematic illustration of a vehicle and a fuel system for the vehicle.

FIG. 2 shows a schematic depiction of a hybrid vehicle system 6 that can derive propulsion power from engine system 8 and/or an on-board energy storage device, such as a battery system (not shown). An energy conversion device, such as a generator (not shown), may be operated to absorb energy from vehicle motion and/or engine operation, and then convert the absorbed energy to an energy form suitable for storage by the energy storage device.

Engine system 8 may include an engine 10 having a plurality of cylinders 30. Engine 10 includes an engine intake 23 and an engine exhaust 25. Engine intake 23 includes an air intake throttle 62 fluidly coupled to the engine intake manifold 44 via an intake passage 42. Air may enter intake passage 42 via air filter 52. Engine exhaust 25 includes an exhaust manifold 48 leading to an exhaust passage 35 that routes exhaust gas to the atmosphere. Engine exhaust 25 may include one or more emission control devices 70 mounted in a close-coupled position. The one or more emission control devices may include a three-way catalyst, lean NOx trap, diesel particulate filter, oxidation catalyst, etc. It will be appreciated that other components may be included in the engine such as a variety of valves and sensors, as further elaborated in herein. In some embodiments, wherein engine system 8 is a boosted engine system, the engine system may further include a boosting device, such as a turbocharger (not shown).

Engine system 8 is coupled to a fuel system 18, and evaporative emissions system 19. Fuel system 18 includes a fuel tank 20 coupled to a fuel pump 21, the fuel tank supplying fuel to an engine 10 which propels a vehicle. Evaporative emissions system 19 includes fuel vapor canister 22. During a fuel tank refueling event, fuel may be pumped into the vehicle from an external source through refueling port 108. Fuel tank 20 may hold a plurality of fuel blends, including fuel with a range of alcohol concentrations, such as various gasoline-ethanol blends, including E10, E85, gasoline, etc., and combinations thereof. A fuel level sensor 106 located in fuel tank 20 may provide an indication of the fuel level ("Fuel Level Input") to controller 12. As depicted, fuel level sensor 106 may comprise a float connected to a variable resistor. Alternatively, other types of fuel level sensors may be used.

Fuel pump 21 is configured to deliver pressurized fuel to the injectors of engine 10, such as example injector 66. While only a single injector 66 is shown, additional injectors are provided for each cylinder. It will be appreciated that fuel system 18 may be a return-less fuel system, a return fuel system, or various other types of fuel system. Vapors generated in fuel tank 20 may be routed to fuel vapor canister 22, via conduit 31, before being purged to the engine intake 23.

Fuel vapor canister 22 is filled with an appropriate adsorbent for temporarily trapping fuel vapors (including vaporized hydrocarbons) generated during fuel tank refueling operations, as well as diurnal vapors. In one example, the adsorbent used is activated charcoal. When purging conditions are met, such as when the canister is saturated, vapors stored in fuel vapor canister 22 may be purged to engine intake 23 by opening canister purge valve 112. While a single canister 22 is shown, it will be appreciated that fuel system 18 may include any number of canisters. In one example, canister purge valve 112 may be a solenoid valve wherein opening or closing of the valve is performed via actuation of a canister purge solenoid.

Canister 22 may include a buffer 22 *a* (or buffer region), each of the canister and the buffer comprising the adsorbent. As shown, the volume of buffer 22 *a* may be smaller than (e.g., a fraction of) the volume of canister 22. The adsorbent in the buffer 22 *a* may be same as, or different from, the adsorbent in the canister (e.g., both may include charcoal). Buffer 22 *a* may be positioned within canister 22 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine.

Canister 22 includes a vent 27 for routing gases out of the canister 22 to the atmosphere (i.e., the ambient surrounding or ambient air) when storing, or trapping, fuel vapors from fuel tank 20. Vent 27 may also allow fresh air to be drawn into fuel vapor canister 22 when purging stored fuel vapors to engine intake 23 via purge line 28 and purge valve 112. While this example shows vent 27 communicating with fresh, unheated air, various modifications may also be used. Vent 27 may include a canister vent valve 114 to adjust a flow of air and vapors between canister 22 and the atmosphere. The canister vent valve may also be used for diagnostic routines. When included, the vent valve may be opened during fuel vapor storing operations (for example, during fuel tank refueling and while the engine is not running) so that air, stripped of fuel vapor after having passed through the canister, can be pushed out to the atmosphere. Likewise, during purging operations (for example, during canister regeneration and while the engine is running), the vent valve may be opened to allow a flow of fresh air to strip the fuel vapors stored in the canister. In one example, canister vent valve 114 may be a solenoid valve wherein opening or closing of the valve is performed via actuation of a canister vent solenoid. In particular, the canister vent valve may be in an open position that is closed upon actuation of the canister vent solenoid.

Evaporative emissions system 19 may further include a bleed canister 111. Hydrocarbons that desorb from canister 22 (hereinafter also referred to as the "main canister may be adsorbed within the bleed canister. Bleed canister 111 may include an adsorbent material that is different than the adsorbent material included in main canister 22. Alternatively, the adsorbent material in bleed canister 111 may be the same as that included in main canister 22.

A hydrocarbon sensor 113 may be present in evaporative emissions system 19 to indicate the concentration of hydrocarbons in vent 27. As illustrated, hydrocarbon sensor 113 is positioned between main canister 22 and bleed canister 111. A probe (e.g., sensing element) of hydrocarbon sensor 113 is exposed to and senses the hydrocarbon concentration of fluid flow in vent 27. Hydrocarbon sensor 113 may be used by the engine control system 190 for determining breakthrough of hydrocarbon vapors from main canister 22, in one example.

One or more temperature sensors 115 may be coupled to and/or within canister 22. As fuel vapor is adsorbed by the adsorbent in the canister, heat is generated (heat of adsorption). Likewise, as fuel vapor is desorbed by the adsorbent in the canister, heat is consumed. In this way, the adsorption and desorption of fuel vapor by the canister may be monitored and estimated based on temperature changes within the canister. Further, one or more canister heaters or heating elements 116 may be coupled to and/or within canister 22. Canister heating element 116 may be used to selectively heat the canister (and the adsorbent contained within) for example, to increase desorption of fuel vapors prior to performing a purge operation. Heating element 116 may comprise an electric heating element, such as a conductive metal, ceramic, or carbon element that may be heated electrically, such as a thermistor. In some embodiments, heating element 116 may comprise a source of microwave energy, or may comprise a canister jacket coupled to a source of hot air or hot water. Heating element 116 may be coupled to one or more heat exchangers that may facilitate the transfer of heat, (e.g., from hot exhaust) to canister 22. Heating element 116 may be configured to heat air within canister 22, and/or to directly heat the adsorbent located within canister 22. In some embodiments, heating element 116 may be included in a heater compartment coupled to the interior or exterior of canister 22. In some embodiments, canister 22 may be coupled to one or more cooling circuits, and/or cooling fans. In this way, canister 22 may be selectively cooled to increase adsorption of fuel vapors (e.g., prior to a refueling event). In some examples, heating element 116 may comprise one or more Peltier elements, which may be configured to selectively heat or cool canister 22.

Hybrid vehicle system 6 may have reduced engine operation times due to the vehicle being powered by engine system 8 during some conditions, and by the energy storage device under other conditions. While the reduced engine operation times reduce overall carbon emissions from the vehicle, they may also lead to insufficient purging of fuel vapors from the vehicle's emission control system. To address this, a fuel tank isolation valve 110 may be optionally included in conduit 31 such that fuel tank 20 is coupled to canister 22 via the valve 110. The fuel tank isolation valve 110 may also be referred to as the fuel tank vent valve. During regular engine operation, isolation valve 110 may be kept closed to limit the amount of diurnal or "running loss" vapors directed to canister 22 from fuel tank 20. During refueling operations, and selected purging conditions, isolation valve 110 may be temporarily opened, e.g., for a duration, to direct fuel vapors from the fuel tank 20 to canister 22. By opening the valve during purging conditions when the fuel tank pressure is higher than a threshold (e.g., above a mechanical pressure limit of the fuel tank), the refueling vapors may be released into the canister and the fuel tank pressure may be maintained below pressure limits. While the depicted example shows isolation valve 110 positioned along conduit 31, in alternate embodiments, the isolation valve may be mounted on fuel tank 20.

One or more pressure sensors 117 may be coupled to fuel system 18 for providing an estimate of a fuel system (and evaporative emissions system) pressure. In one example, the fuel system pressure, and in some example evaporative emissions system pressure as well, is indicated by pressure sensor 117, where pressure sensor 117 is a fuel tank pressure transducer (FTPT) coupled to fuel tank 20. While the depicted example shows pressure sensor 117 directly coupled to fuel tank 20, in alternate embodiments, the pressure sensor may be coupled between the fuel tank and canister 22, specifically between the fuel tank 20 and isolation valve 110 along conduit 31. In still other embodiments, a first pressure sensor may be positioned upstream of the isolation valve (between the isolation valve and the canister) while a second pressure sensor is positioned downstream of the isolation valve (between the isolation valve and the fuel tank), to provide an estimate of a pressure difference across the valve. In some examples, a vehicle control system may infer and indicate undesired evaporative emissions based on changes in a fuel tank (and evaporative emissions system) pressure during an evaporative emissions diagnostic routine.

One or more temperature sensors 121 may also be coupled to fuel system 18 for providing an estimate of a fuel system temperature. In one example, the fuel system temperature is a fuel tank temperature, wherein temperature sensor 121 is a fuel tank temperature sensor coupled to fuel tank 20 for estimating a fuel tank temperature. While the depicted example shows temperature sensor 121 directly coupled to fuel tank 20, in alternate embodiments, the temperature sensor may be coupled between the fuel tank and canister 22.

Fuel vapors released from canister 22, for example during a purging operation, may be directed into engine intake manifold 44 via purge line 28. The flow of vapors along purge line 28 may be regulated by canister purge valve 112, coupled between the fuel vapor canister and the engine intake. The quantity and rate of vapors released by the canister purge valve may be determined by the duty cycle of an associated canister purge valve solenoid (not shown). As such, the duty cycle of the canister purge valve solenoid may be determined by the vehicle's powertrain control module (PCM), such as controller 12, responsive to engine operating conditions, including, for example, engine speed-load conditions, an air-fuel ratio, a canister load, etc. By commanding the canister purge valve to be closed, the controller may seal the fuel vapor recovery system from the engine intake. An optional canister check valve (not shown) may be included in purge line 28 to prevent intake manifold pressure from flowing gases in the opposite direction of the purge flow. As such, the check valve may be necessary if the canister purge valve control is not accurately timed or the canister purge valve itself can be forced open by a high intake manifold pressure. An estimate of the manifold absolute pressure (MAP) or manifold vacuum (ManVac) may be obtained from MAP sensor 118 coupled to intake manifold 44, and communicated with controller 12. Alternatively, MAP may be inferred from alternate engine operating conditions, such as mass air flow (MAF), as measured by a MAF sensor (not shown) coupled to the intake manifold.

Fuel system 18 and evaporative emissions system 19 may be operated by controller 12 in a plurality of modes by selective adjustment of the various valves and solenoids. For example, the fuel system and evaporative emissions system may be operated in a fuel vapor storage mode (e.g., during a fuel tank refueling operation and with the engine not running), wherein the controller 12 may open isolation valve 110 and canister vent valve 114 while closing canister purge valve (CPV) 112 to direct refueling vapors into canister 22 while preventing fuel vapors from being directed into the intake manifold.

As another example, the fuel system and evaporative emissions system may be operated in a refueling mode (e.g., when fuel tank refueling is requested by a vehicle operator), wherein the controller 12 may open isolation valve 110 and canister vent valve 114, while maintaining canister purge valve 112 closed, to depressurize the fuel tank before enabling fuel to be added therein. As such, isolation valve 110 may be kept open during the refueling operation to allow refueling vapors to be stored in the canister. After refueling is completed, the isolation valve may be closed.

As yet another example, the fuel system and evaporative emissions system may be operated in a canister purging mode (e.g., after an emission control device light-off temperature has been attained and with the engine running), wherein the controller 12 may open canister purge valve 112 and canister vent valve while closing isolation valve 110. Herein, the vacuum generated by the intake manifold of the operating engine may be used to draw fresh air through vent 27 and through fuel vapor canister 22 to purge the stored fuel vapors into intake manifold 44. In this mode, the purged fuel vapors from the canister are combusted in the engine. The purging may be continued until the stored fuel vapor amount in the canister is below a threshold. During purging, the learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel vapor canister. For example, one or more oxygen sensors (not shown) may be coupled to the canister 22 (e.g., downstream of the canister), or positioned in the engine intake and/or engine exhaust, to provide an estimate of a canister load (that is, an amount of fuel vapors stored in the canister). Based on the canister load, and further based on engine operating conditions, such as engine speed-load conditions, a purge flow rate may be determined.

Vehicle system 6 may further include control system 190. Control system 190 is shown receiving information from a plurality of sensors 16 (various examples of which are described herein) and sending control signals to a plurality of actuators 81 (various examples of which are described herein). As one example, sensors 16 may include exhaust gas sensor 126 located upstream of the emission control device, temperature sensor 128, MAP sensor 118, pressure sensor 117, hydrocarbon sensor 113, temperature sensor 121, and pressure sensor 129. Other sensors such as additional pressure, temperature, air/fuel ratio, and composition sensors may be coupled to various locations in the vehicle system 6. As another example, the actuators may include fuel injector 66, isolation valve 110, purge valve 112, vent valve 114, fuel pump 21, and throttle 62.

Control system 190 may further receive information regarding the location of the vehicle from an on-board global positioning system (GPS). Information received from the GPS may include vehicle speed, vehicle altitude, vehicle position, etc. This information may be used to infer engine operating parameters, such as local barometric pressure. Control system 190 may further be configured to receive information via the internet or other communication networks. Information received from the GPS may be cross-referenced to information available via the internet to determine local weather conditions, local vehicle regulations, etc. Control system 190 may use the internet to obtain updated software modules which may be stored in non-transitory memory.

The control system 190 may include a controller 12. Controller 12 may be configured as a conventional microcomputer including a microprocessor unit, input/output ports, read-only memory, random access memory, keep alive memory, a controller area network (CAN) bus, etc. Controller 12 may be configured as a powertrain control module (PCM). The controller may be shifted between sleep and wake-up modes for additional energy efficiency. The controller may receive input data from the various sensors, process the input data, and trigger the actuators in response to the processed input data based on instruction or code programmed therein corresponding to one or more routines. An example control routine is described herein with regard to FIGS. 3 and 5.

Controller 12 may also be configured to intermittently perform evaporative emissions detection routines on fuel system 18 and evaporative emissions system 19 to determine the presence or absence of undesired evaporative emissions in the fuel system and/or evaporative emissions system. As such, various diagnostic evaporative emissions diagnostic tests may be performed while the engine is off (engine-off evaporative emissions test) or while the engine is running (engine-on evaporative emissions test). Evaporative emissions tests performed while the engine is running may include applying a negative pressure on the fuel system and evaporative emissions system for a duration (e.g., until a target vacuum is reached) and then sealing the fuel system and evaporative emissions system while monitoring a change in pressure (e.g., a rate of change in the vacuum level, or a final pressure value). Evaporative emissions tests performed while the engine is not running may include sealing the fuel system and evaporative emissions system following engine shut-off and monitoring a change in pressure to detect for leaks. This type of evaporative emissions test is referred to herein as an engine-off natural vacuum test (EONV), or more specifically the EONV 0.02" leak detection test. In sealing the fuel system and evaporative emissions system following engine shut-off, pressure in such a fuel system and evaporative emissions control system will increase if the tank is heated further (e.g., from hot exhaust or a hot parking surface) as liquid fuel vaporizes. If the pressure rise meets or exceeds a predetermined threshold, it may be indicated that the fuel system and the evaporative emissions control system are free from undesired evaporative emissions. Alternatively, if during the pressure rise portion of the test the pressure curve reaches a zero-slope prior to reaching the threshold, as fuel in the fuel tank cools, a vacuum is generated in the fuel system and evaporative emissions system as fuel vapors condense to liquid fuel. Vacuum generation may be monitored and undesired emissions identified based on expected vacuum development or expected rates of vacuum development. In such an example, the EONV test may be monitored for a period of time based on available battery charge.

The purpose of this disclosure is to provide a method of diagnosing whether or not canister heating element 116 is operating properly within in a noise free environment where engine heat, catalyst heat, etc., do not confound the results of the diagnosis. The controller 12 has a wakeup capability. When the vehicle is shutdown or turned off (i.e., at "key off"), the controller 12 may programmed to wake up 4-6 hours later when the engine 10, underbody, and fuel have cooled down. Also, at key off, the EONV 0.02" leak detection test must run and the evaporative emissions system 19 as being leak-free. This is an entry condition for the method of diagnosing whether or not canister heating element 116 is operating properly.

Figure 3:
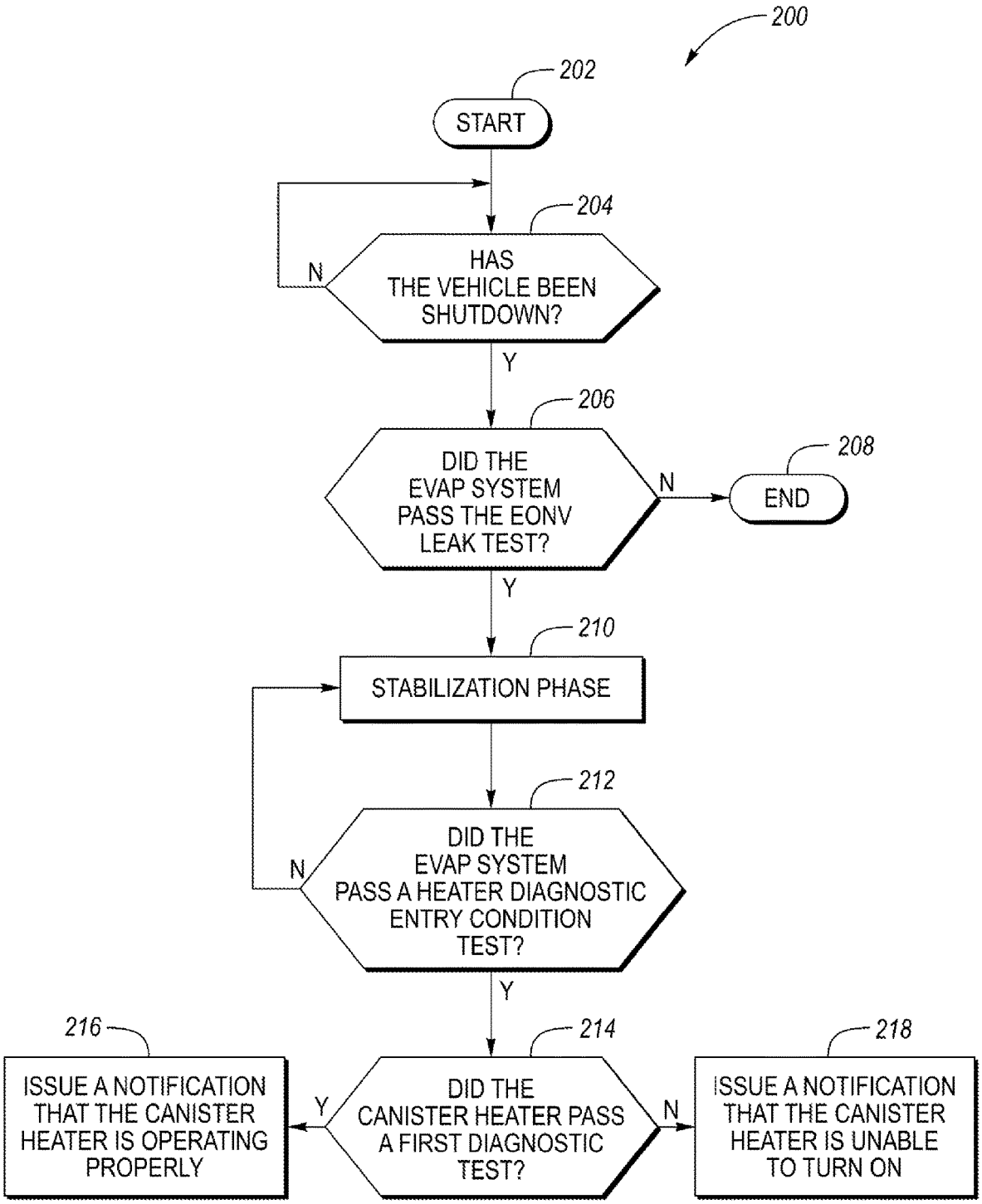
FIG. 3 is a flowchart illustrating a first method for determining the operability of a canister heater of a vehicle evaporative emissions system.
Figure 4:
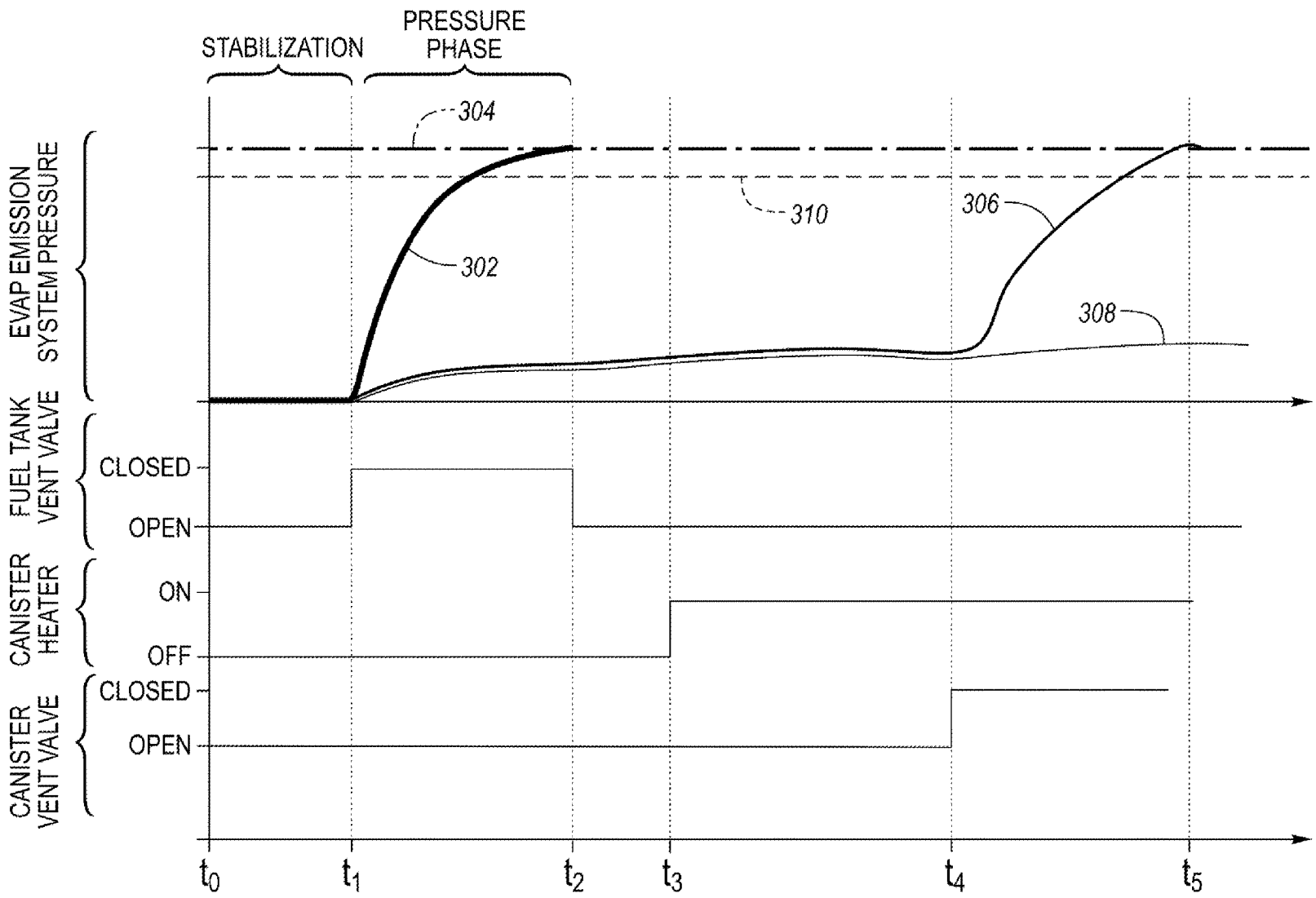
FIG. 4 is a series of graphs illustrating the conditions of various vehicle components while the first method is being implemented.

Referring to FIGS. 3 and 4, a flowchart of a first method 200 for determining the operability of the canister heater 116 and a series of graphs of conditions of various vehicle components while the first method is being implemented are illustrated, respectively. The first method 200 may be stored as control logic and/or an algorithm within the controller 12. The first method 200 is initiated at start block 202. Next, the first method 200 moves on to block 204 where it is determined if the vehicle has been shutdown (i.e., if the vehicle been transitioned to a "key off" state). If the answer at block 204 is NO, the method 200 recycles back to the beginning of block 204. If the answer at block 204 is YES, the first method 200 moves on to block 206 where the EONV leak detection test is initiated and where it is determined if the evaporative emissions system 19 passed the EONV leak detection test. If the evaporative emissions system 19 has not passed the EONV leak detection test, the first method 200 ends at end block 208 and no diagnosis test for determining the operability of the canister heater 116 is conducted during the current "key off" cycle.

If the evaporative emissions system 19 has passed the EONV leak detection test, the first method 200 moves on to block 210 where the fuel tank vent valve 110 is opened, the canister vent valve 114 is opened, and the canister heater 116 is deactivated or shutdown. It should be noted that if the fuel tank vent valve 110 is already open, the canister vent valve 114 is already open, and/or the canister heater 116 is already shutdown at block 210, such conditions may simply be maintained and no transition is required. Opening the fuel tank vent valve 110, opening the canister vent valve 114, and shutting down the canister heater 116 at block 210 corresponds to the evaporative emissions system 19 entering into a stabilization phase where the temperature and pressure of the fuel vapors and air within the subcomponents of the evaporative emissions system 19 (e.g., fuel tank 20 and canister 22) transition toward the temperature and pressure of the ambient surroundings (e.g., the ambient air). The stabilization phase is illustrated between times $t_0$ and $t_1$ in FIG. 4.

The method 200 next moves on to block 212 where a diagnostic entry condition test is initiated and where it is determined if the evaporative emissions system 19 passed the diagnostic entry condition test. The diagnostic entry condition test may be initiated after a predetermined period time after the vehicle has been shutdown. The predetermined period of time may correspond to a time period after the vehicle has been shutdown where the controller 12 is programmed to wake up when it is expected that the engine 10, underbody, and fuel have cooled down after the previous drive cycle. The predetermined period of time may be several hours to ensure sufficient cooling. The diagnostic entry condition test includes closing the fuel tank vent valve 110, maintaining the open condition of the canister vent valve 114, maintaining the deactivated condition of the canister heater 116, and monitoring the vapor pressure of the fuel in the fuel tank 20 via pressure sensor 117.

If the vapor pressure of the fuel in the fuel tank 20 increases to beyond a first pressure threshold at block 212, the fuel is vaporous or hot and the method 200 aborts or forgoes initiating a first diagnostic test (i.e., the step in block 214) and the returns to the stabilization phase at block 210. The controller 12 may then be rescheduled to wake up again after another predetermined period of time to reinitiate the diagnostic entry condition test at block 212. Line 302 in FIG. 3 illustrates a scenario where the method 200 would abort or forgo initiating the first diagnostic test and line 304 in FIG. 3 illustrates the first pressure threshold. The time period where the diagnostic entry condition test occurs may be a predetermined relatively short period of time that only may last a few minutes and may be referred to as the pressure phase which occurs between times $t_1$ and $t_2$ in FIG. 4.

If the fuel vapor pressure had stabilized at block 210, the vapor pressure of the fuel in the fuel tank 20 will not increase to beyond the first pressure threshold at block 212 once the fuel tank vent valve 110 is closed since the liquid fuel and the outside ambient air temperature are approximately equal. Therefore, the first pressure threshold may correspond to an allowable difference between the vapor pressure and the pressure of ambient surroundings. The method 200 moves on to block 214 if the vapor pressure does not increase to greater than the first pressure threshold during the time period between times $t_1$ and $t_2$ in FIG. 4. Lines 306 and 308 in FIG. 3 illustrate a scenarios where the vapor pressure has not increased to greater than the first pressure threshold.

At block 214, the method 200 initiates a first diagnostic test to determine the operability of the canister heater 116. The first diagnostic test includes opening the fuel tank vent valve 110, closing the canister vent valve 114, activating the canister heater 116, and monitoring the fuel vapor pressure within the evaporative emissions system 19 via pressure sensor 117. If the pressure of the fuel vapor exceeds a second pressure threshold during the first diagnostic test, the method 200 moves on to block 216, where the controller 12 outputs a signal or issues a notification indicating that the canister heater 116 is operating properly. The signal may be transmitted to the vehicle instrument panel 196 which communicates the operating condition of the canister heater 116 to the operator in the form of an indicator light and/or a text-based messages. Line 306 in FIG. 3 illustrates a scenario where the method 200 has determined that the canister heater 116 is operating properly and line 310 in FIG. 3 illustrates the second pressure threshold.

Returning to block 214, if the pressure of the fuel vapor does not exceed the second pressure threshold during the first diagnostic test, the method 200 moves on to block 218, where the controller 12 outputs a signal or issues a notification indicating that the canister heater 116 is unable to turn on or is "stuck off" The signal may be transmitted to the vehicle instrument panel 196 which communicates the operating condition of the canister heater 116 to the operator in the form of an indicator light and/or a text-based messages. Line 308 in FIG. 3 illustrates a scenario where the method 200 has determined that the canister heater 116 is unable to turn on. The first diagnostic test occurs between times $t_2$ and $t_5$ in FIG. 4, and is initiated once the fuel tank vent valve 110 is opened. The canister heater 116 may then be activated after the fuel tank vent valve 110 is opened. Furthermore, the canister heater 116 may be activated for a predetermined time prior to closing the canister purge valve 112. Such predetermined time period is illustrated between times $t_3$ and $t_4$ in FIG. 4.

It should be understood that the flowchart in FIG. 3 is for illustrative purposes only and that the method 200 should not be construed as limited to the flowchart in FIG. 200. Some of the steps of the method 200 may be rearranged while others may be omitted entirely.

Figure 5:
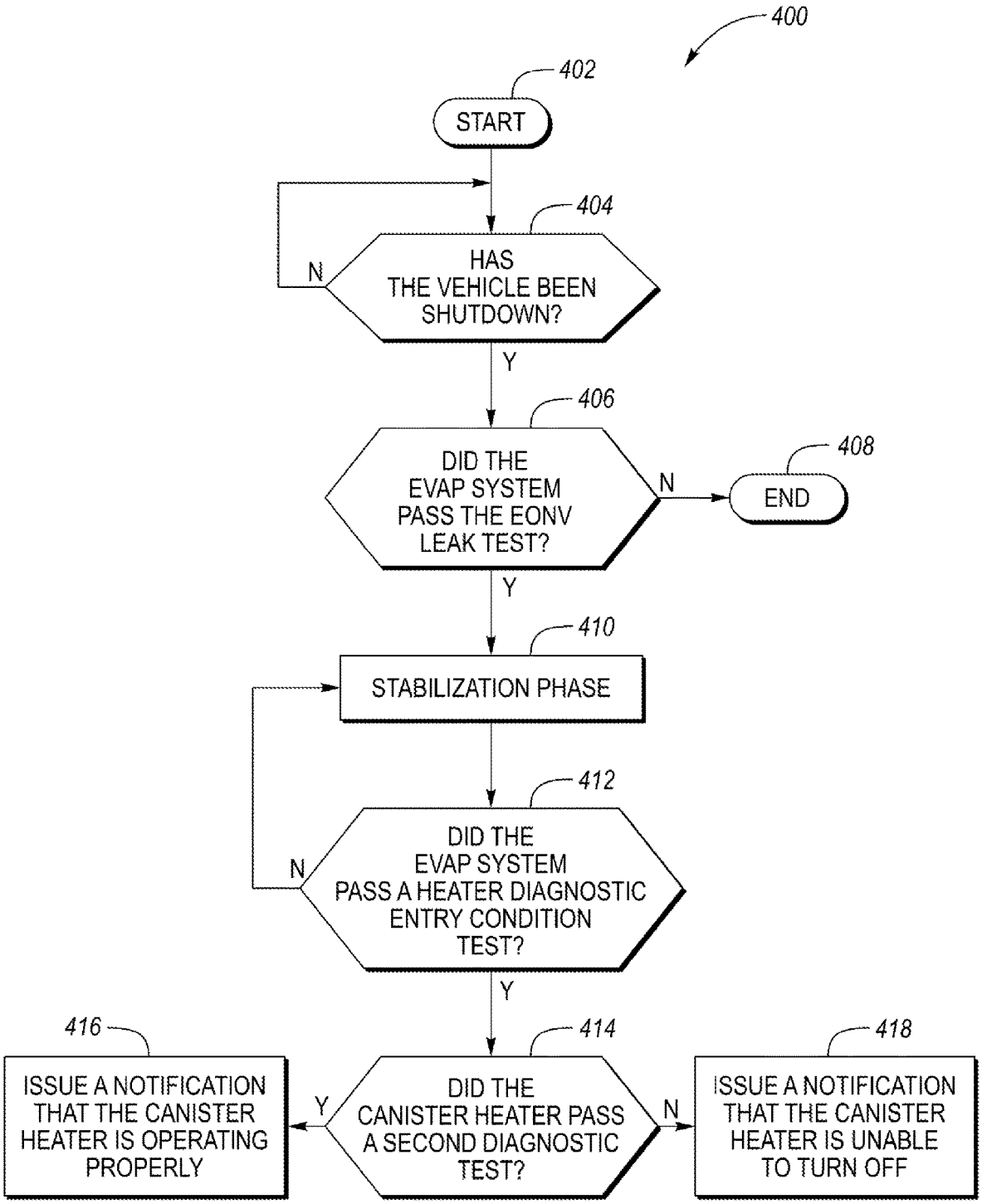
FIG. 5 is a flowchart illustrating a second method for determining the operability of the canister heater.
Figure 6:
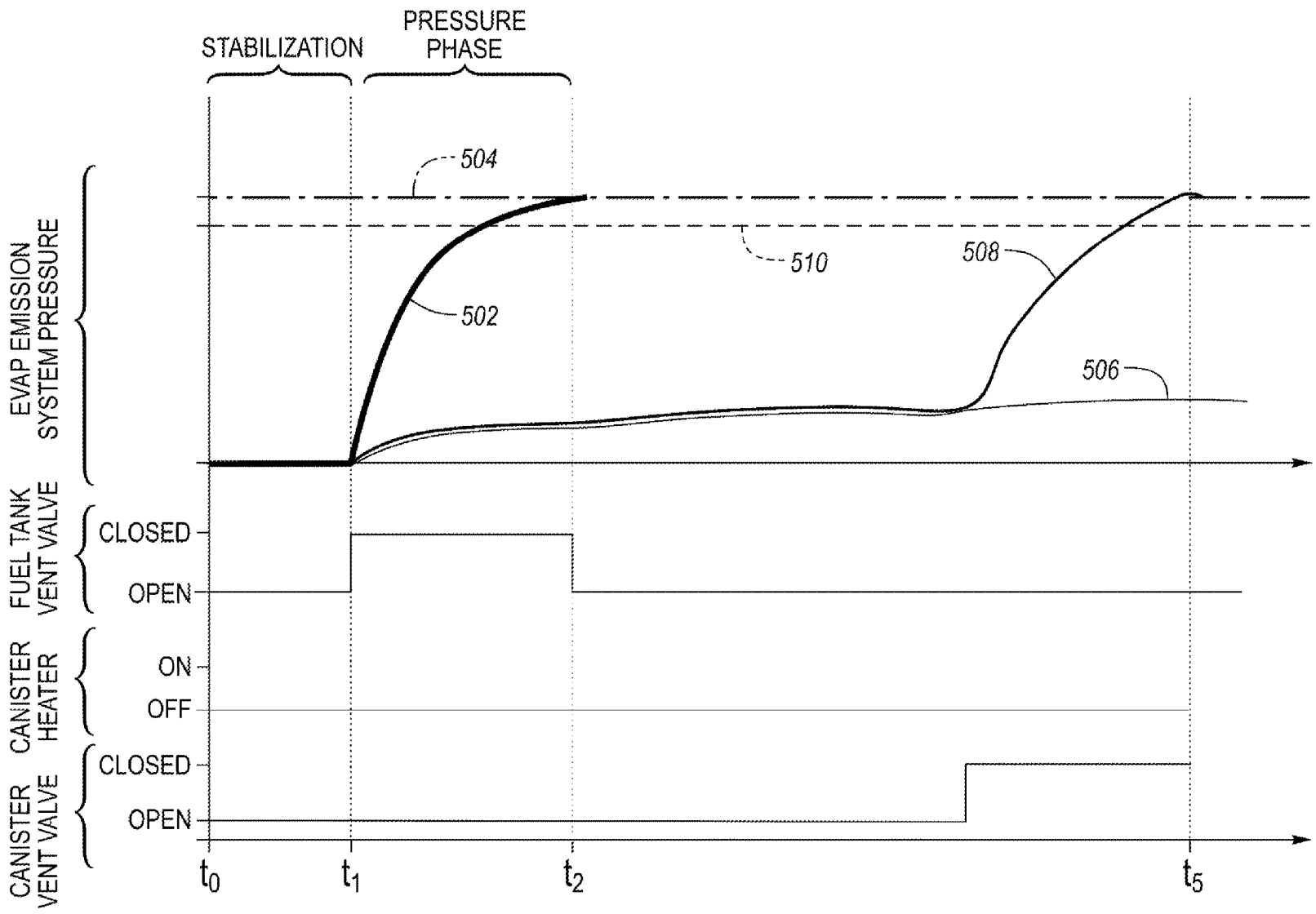
FIG. 6 is a graph illustrating the conditions of various vehicle components while the second method is implemented.

Referring to FIGS. 5 and 6, a flowchart of a second method 400 for determining the operability of the canister heater 116 and a series of graphs of conditions of various vehicle components while the second method is being implemented are illustrated, respectively. The second method 400 may be stored as control logic and/or an algorithm within the controller 12. The second method 400 is initiated at start block 402. Next, the second method 400 moves on to block 404 where it is determined if the vehicle has been shutdown (i.e., if the vehicle been transitioned to a "key off" state). If the answer at block 404 is NO, the method 400 recycles back to the beginning of block 404. If the answer at block 404 is YES, the second method 400 moves on to block 406 where the EONV leak detection test is initiated and where it is determined if the evaporative emissions system 19 passed the EONV leak detection test. If the evaporative emissions system 19 has not passed the EONV leak detection test, the second method 400 ends at end block 408 and no diagnosis test for determining the operability of the canister heater 116 is conducted during the current "key off" cycle.

If the evaporative emissions system 19 has passed the EONV leak detection test, the second method 400 moves on to block 410 where the fuel tank vent valve 110 is opened, the canister vent valve 114 is opened, and the canister heater 116 is deactivated or shutdown. It should be noted that if the fuel tank vent valve 110 is already open, the canister vent valve 114 is already open, and/or the canister heater 116 is already shutdown at block 410, such conditions may simply be maintained and no transition is required. Opening the fuel tank vent valve 110, opening the canister vent valve 114, and shutting down the canister heater 116 at block 410 corresponds to the evaporative emissions system 19 entering into a stabilization phase where the temperature and pressure of the fuel vapors and air within the subcomponents of the evaporative emissions system 19 (e.g., fuel tank 20 and canister 22) transition toward the temperature and pressure of the ambient surroundings (e.g., the ambient air). The stabilization phase is illustrated between times $t_0$ and $t_1$ in FIG. 6.

The method 400 next moves on to block 412 where a diagnostic entry condition test is initiated and where it is determined if the evaporative emissions system 19 passed the diagnostic entry condition test. The diagnostic entry condition test may be initiated after a predetermined period time after the vehicle has been shutdown. The predetermined period of time may correspond to a time period after the vehicle has been shutdown where the controller 12 is programmed to wake up when it is expected that the engine 10, underbody, and fuel have cooled down after the previous drive cycle. The predetermined period of time may be several hours to ensure sufficient cooling. The diagnostic entry condition test includes closing the fuel tank vent valve 110, maintaining the open condition of the canister vent valve 114, maintaining the deactivated condition of the canister heater 116, and monitoring the vapor pressure of the fuel in the fuel tank 20 via pressure sensor 117.

If the vapor pressure of the fuel in the fuel tank 20 increases to beyond a first pressure threshold at block 412, the fuel is vaporous or hot and the method 400 aborts or forgoes initiating a second diagnostic test (i.e., the step in block 414) and the returns to the stabilization phase at block 410. The controller 12 may then be rescheduled to wake up again after another predetermined period of time to reinitiate the diagnostic entry condition test at block 412. Line 502 in FIG. 6 illustrates a scenario where the method 400 would abort or forgo initiating the second diagnostic test and line 504 in FIG. 6 illustrates the first pressure threshold. The time period where the diagnostic entry condition test occurs may be a predetermined relatively short period of time that only may last a few minutes and may be referred to as the pressure phase which occurs between times $t_1$ and $t_2$ in FIG. 6.

If the fuel vapor pressure had stabilized at block 410, the vapor pressure of the fuel in the fuel tank 20 will not increase to beyond the first pressure threshold at block 412 once the fuel tank vent valve 110 is closed since the liquid fuel and the outside ambient air temperature are approximately equal. Therefore, the first pressure threshold may correspond to an allowable difference between the vapor pressure and the pressure of ambient surroundings. The method 400 moves on to block 414 if the vapor pressure does not increase to greater than the first pressure threshold during the time period between times $t_1$ and $t_2$ in FIG. 6. Lines 506 and 508 in FIG. 6 illustrate a scenarios where the vapor pressure has not increased to greater than the first pressure threshold.

At block 414, the method 400 initiates a second diagnostic test to determine the operability of the canister heater 116. The second diagnostic test includes opening the fuel tank vent valve 110, closing the canister vent valve 114, deactivating the canister heater 116, and monitoring the fuel vapor pressure within the evaporative emissions system 19 via pressure sensor 117. If the pressure of the fuel vapor does not exceed a third pressure threshold during the second diagnostic test, the method 400 moves on to block 416, where the controller 12 outputs a signal or issues a notification indicating that the canister heater 116 is operating properly. The signal may be transmitted to the vehicle instrument panel 196 which communicates the operating condition of the canister heater 116 to the operator in the form of an indicator light and/or a text-based messages. Line 506 in FIG. 6 illustrates a scenario where the method 400 has determined that the canister heater 116 is operating properly and line 510 in FIG. 6 illustrates the third pressure threshold.

Returning to block 414, if the pressure of the fuel vapor does exceed the third pressure threshold during the second diagnostic test, the method 400 moves on to block 418, where the controller 12 outputs a signal or issues a notification indicating that the canister heater 116 is unable to turn off or is "stuck on." The signal may be transmitted to the vehicle instrument panel 196 which communicates the operating condition of the canister heater 116 to the operator in the form of an indicator light and/or a text-based messages. Line 508 in FIG. 6 illustrates a scenario where the method 400 has determined that the canister heater 116 is unable to turn off. The second diagnostic test occurs between times $t_2$ and $t_5$ in FIG. 6, and is initiated once the fuel tank vent valve 110 is opened.

It should be understood that the flowchart in FIG. 5 is for illustrative purposes only and that the method 400 should not be construed as limited to the flowchart in FIG. 5. Some of the steps of the method 400 may be rearranged while others may be omitted entirely.

The canister purge valve 112 may remain closed during either the first method 200 or second method 400 for determining the operability of the canister heater 116. Furthermore, the first method 200 or second method 400 may each be utilized in a hybrid vehicle where an evaporate leak check module (ELCM) is utilized as opposed to canister purge valve 112. An ELCM is disclosed in U.S. Pat. App. No. 2017/0114732, filed on Oct. 27, 2015, which is incorporated by reference herein in its entirety.

It should be understood that the designations of first, second, third, fourth, etc. for any component, state, or condition described herein may be rearranged in the claims so that they are in chronological order with respect to the claims.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A vehicle comprising:

a fuel tank configured to store fuel;

a canister in fluid communication with the fuel tank and configured to receive and store evaporated fuel from the fuel tank;

a first valve disposed between the fuel tank and the canister;

a second valve disposed between the canister and ambient surroundings;

a heater disposed within the canister; and a controller programmed to, periodically initiate a diagnostic test, the diagnostic test including, opening the first valve, closing the second valve, deactivating the heater, and sensing a vapor pressure within the fuel tank, in response to the vapor pressure being less than a threshold during the diagnostic test, output a signal indicating that the heater is operating properly, and in response to the vapor pressure exceeding the threshold during the diagnostic test, output a signal indicating that the heater is unable to turn off.

2. The vehicle of claim 1, wherein the controller is programmed to, in response to the vehicle being shutdown prior to initiating the diagnostic test, open the first and second valves, and deactivate the heater, and in response to a predetermined period of time elapsing after the vehicle being shutdown and prior to initiating the diagnostic test, close the first valve, maintain an open condition of the second valve, maintain a deactivated condition of the heater, and observe the vapor pressure.

3. The vehicle of claim 2, wherein the controller is programmed to, in response to a difference between the vapor pressure and an ambient surrounding pressure being less than a second threshold, while the first valve is closed, the second valve is open, and the heater is deactivated, initiate the diagnostic test.

4. The vehicle of claim 3, wherein the controller is programmed to, in response to the difference between the vapor pressure and the ambient surrounding pressure being greater than the second threshold, while the first valve is closed, the second valve is open, and the heater is deactivated, forgo the diagnostic test.

5. The vehicle of claim 1, wherein the controller is programmed to, periodically initiate a second diagnostic test, the diagnostic test including, opening the first valve, closing the second valve, activating the heater, and sensing the vapor pressure within the fuel tank, in response to the vapor pressure being greater than a second threshold during the second diagnostic test, output a signal indicating that the heater is operating properly, and in response to the vapor pressure being less than the second threshold during the second diagnostic test, output a signal indicating that the heater is unable to turn on.

6. The vehicle of claim 5, wherein the controller is programmed to, in response to the vehicle being shutdown prior to initiating the second diagnostic test, open the first and second valves, and deactivate the heater, in response to a predetermined period of time elapsing after the vehicle being shutdown and prior to initiating the diagnostic test, close the first valve, maintain an open condition of the second valve, maintain a deactivated condition of the heater, and sense the vapor pressure, in response to a difference between the vapor pressure and an ambient surrounding pressure being less than a second threshold, while the first valve is closed, the second valve is open, and the heater is deactivated, initiate the second diagnostic test, and in response to the difference between the vapor pressure and the ambient surrounding pressure being greater than the second threshold, while the first valve is closed, the second valve is open, and the heater is deactivated, forgo the second diagnostic test.

7. A vehicle comprising:

a fuel tank configured to store fuel;

a canister in fluid communication with the fuel tank and configured to receive evaporated fuel from the fuel tank, store the evaporated fuel via adsorption, and deliver the evaporated fuel to an engine via desorption;

a fuel tank vent valve disposed between the fuel tank and the canister, the fuel tank vent valve configured to facilitate fuel vapor flow from the fuel tank to the canister when open and to isolate the fuel tank from the canister when closed;

a canister vent valve disposed between the canister and ambient surroundings, the canister vent valve configured to facilitate fluid communication between the canister and the ambient surroundings when open and to isolate the canister from the ambient surroundings when closed;

a pressure sensor disposed between the canister and the fuel tank and configured to measure a pressure of the fuel vapor;

an electric heater disposed within the canister and configured to accelerate desorption; and a controller programmed to, periodically initiate a first diagnostic test, the first diagnostic test including, opening the fuel tank vent valve, closing the canister vent valve, and activating the electric heater, in response to the pressure sensor sensing an increase in the pressure of the fuel vapor exceeding a threshold during the first diagnostic test, output a signal indicating that the electric heater is operating properly, in response to the pressure sensor sensing the increase in the pressure of the fuel vapor being less than the threshold during the first diagnostic test, output a signal indicating that the electric heater is unable to turn on, periodically initiate a second diagnostic test, the second diagnostic test including, opening the fuel tank vent valve, closing the canister vent valve, and deactivating the electric heater, in response to the pressure sensor sensing the increase in the pressure of the fuel vapor being less than the second threshold during the second diagnostic test, output a signal indicating that the electric heater is operating properly, and in response to the pressure sensor sensing the increase in the pressure of the fuel vapor exceeding a second threshold during the second diagnostic test, output a signal indicating that the electric heater is unable to turn off.

8. The vehicle of claim 7, wherein the controller is programmed to, in response to the vehicle being shutdown prior to initiating the first diagnostic test, open or maintain open conditions of the fuel tank vent valve and the canister vent valve, and deactivate or maintain a deactivated condition of the electric heater, and in response to a predetermined period of time elapsing after the vehicle being shutdown and prior to initiating the first diagnostic test, close the fuel tank vent valve, maintain the open condition of the canister vent valve, maintain the deactivated condition of the electric heater, and sense the pressure of the fuel vapor via the pressure sensor.

9. The vehicle of claim 8, wherein the controller is programmed to, in response to the pressure sensor sensing a difference between the pressures of the fuel vapor and the ambient surroundings being less than a third threshold, while the fuel tank vent valve is closed, the canister vent valve is open, and the electric heater is deactivated, initiate the first diagnostic test.

10. The vehicle of claim 9, wherein the controller is programmed to, in response to the pressure sensor sensing the difference between the pressures of the fuel vapor and the ambient surroundings being greater than the third threshold, while the fuel tank vent valve is closed, the canister vent valve is open, and the electric heater is deactivated, forgo the first diagnostic test.

11. The vehicle of claim 7, wherein the controller is programmed to, in response to initiating the first diagnostic test, activate the electric heater for a predetermined period of time prior to closing the canister vent valve.

12. The vehicle of claim 7, wherein the controller is programmed to, in response to the vehicle being shutdown prior to initiating the second diagnostic test, open or maintain open conditions of the fuel tank vent valve and the canister vent valve, and deactivate or maintain a deactivated condition of the electric heater, and in response to a predetermined period of time elapsing after the vehicle being shutdown and prior to initiating the second diagnostic test, close the fuel tank vent valve, maintain the open condition of the canister vent valve, maintain the deactivated condition of the electric heater, and sense the pressure of the fuel vapor via the pressure sensor.

13. The vehicle of claim 12, wherein the controller is programmed to, in response to the pressure sensor sensing a difference between the pressures of the fuel vapor and the ambient surroundings being less than a third threshold, while the fuel tank vent valve is closed, the canister vent valve is open, and the electric heater is deactivated, initiate the second diagnostic test.

14. The vehicle of claim 13, wherein the controller is programmed to, in response to the pressure sensor sensing the difference between the pressures of the fuel vapor and the ambient surroundings being greater than the third threshold, while the fuel tank vent valve is closed, the canister vent valve is open, and the electric heater is deactivated, forgo the second diagnostic test.

15. A vehicle comprising:

a fuel tank configured to store fuel;

a canister in fluid communication with the fuel tank and configured to receive and store evaporated fuel from the fuel tank;

a first valve disposed between the fuel tank and the canister;

a second valve disposed between the canister and ambient surroundings;

a heater disposed within the canister; and a controller programmed to, periodically initiate a diagnostic test, the diagnostic test including, opening the first valve, closing the second valve, activating the heater, and sensing a vapor pressure within the fuel tank, in response to the vapor pressure being greater than a threshold during the diagnostic test, output a signal indicating that the heater is operating properly, and in response to the vapor pressure being less than the threshold during the diagnostic test, output a signal indicating that the heater is unable to turn on.

16. The vehicle of claim 15, wherein the controller is programmed to, in response to the vehicle being shutdown prior to initiating the diagnostic test, open the first and second valves, and deactivate the heater, and in response to a predetermined period of time elapsing after the vehicle being shutdown and prior to initiating the diagnostic test, close the first valve, maintain an open condition of the second valve, maintain a deactivated condition of the heater, and sense the vapor pressure.

17. The vehicle of claim 16, wherein the controller is programmed to, in response to a difference between the vapor pressure and an ambient surrounding pressure being less than a second threshold, while the first valve is closed, the second valve is open, and the heater is deactivated, initiate the diagnostic test.

18. The vehicle of claim 16, wherein the controller is programmed to, in response to a difference between the vapor pressure and an ambient surrounding pressure being greater than the second threshold, while the first valve is closed, the second valve is open, and the heater is deactivated, forgo the diagnostic test.

19. The vehicle of claim 15, wherein the controller is programmed to, in response to the vehicle being shutdown for a second predetermined period of time, initiate a second diagnostic test, the second diagnostic test including, opening the first valve, closing the second valve, deactivating the heater, and sensing a vapor pressure within the fuel tank, in response to the vapor pressure being less than a second threshold during the second diagnostic test, output a signal indicating that the heater is operating properly, and in response to the vapor pressure exceeding the second threshold during the second diagnostic test, output a signal indicating that the heater is unable to turn off.

20. The vehicle of claim 15, wherein the controller is programmed to, in response to initiating the diagnostic test, activate the heater for a predetermined period of time prior to closing the second valve.

* * * * *